US006354610B1

(12) United States Patent
Dodge

(10) Patent No.: US 6,354,610 B1
(45) Date of Patent: Mar. 12, 2002

(54) METHOD AND APPARATUS FOR INTERFACING A SNOWBOARD BOOT TO A BINDING

(75) Inventor: David J. Dodge, Williston, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/338,536

(22) Filed: Jun. 23, 1999

Related U.S. Application Data

(63) Continuation of application No. 08/584,053, filed on Jan. 8, 1996, now Pat. No. 6,126,179, which is a continuation-in-part of application No. 08/375,971, filed on Jan. 20, 1995, now abandoned.

(51) Int. Cl.[7] ..... B62B 9/99

(52) U.S. Cl. ..... 280/14.22; 280/14.21; 280/624; 36/117.1; 36/117.3

(58) Field of Search ..... 280/14.2, 14.22, 280/14.21, 14.24, 624; 36/15, 115, 117.1, 117.3, 132

(56) References Cited

U.S. PATENT DOCUMENTS

| | | | |
|---|---|---|---|
| 2,950,118 | A | 8/1960 | Sharpe |
| 3,140,877 | A | 7/1964 | Spademan |
| 3,271,040 | A | 9/1966 | Spademan |
| 3,280,411 | A | 10/1966 | Brock |
| 3,494,628 | A | 2/1970 | Spademan |
| RE26,972 | E | 10/1970 | Spademan |
| 3,545,103 | A | 12/1970 | Bloomfield et al. |
| 3,560,011 | A | 2/1971 | Spademan |
| 3,718,994 | A | 3/1973 | Spier |
| 3,775,875 | A | 12/1973 | Dvorsky |
| 3,797,841 | A | 3/1974 | McAusland |
| 3,824,713 | A | 7/1974 | Vaccari |
| 3,852,896 | A | 12/1974 | Pyzel et al. |
| 3,869,136 | A | 3/1975 | Jackson |
| 3,884,492 | A | 5/1975 | Spademan |

(List continued on next page.)

FOREIGN PATENT DOCUMENTS

| | | |
|---|---|---|
| AT | E11 005 B1 | 9/1982 |
| CH | 678494 A5 | 9/1991 |
| DE | 23 59 309 | 5/1975 |
| DE | 3910156 A1 | 10/1990 |
| DE | 4344647 A1 | 6/1995 |
| EP | 0059022 B1 | 9/1982 |
| EP | 0397 969 A1 | 11/1990 |
| EP | 0669 147 A2 | 8/1995 |
| EP | 0 707 873 | 4/1996 |
| EP | 0740908 A1 | 11/1996 |

(List continued on next page.)

OTHER PUBLICATIONS

Partial Translation of JP Laying Open No. 7–303728.

Derwent English Language Abstracts for the following references: CH 678494: DE 39 101 56: DE 43 44647; EP 394 696; EP 669 147; FR 2 628 981; FR 2 644 074; FR 2 652 753; FR 2 689 776; FR 2 705 248.

*Primary Examiner*—J. J. Swann
*Assistant Examiner*—James S. McClellan
(74) *Attorney, Agent, or Firm*—Wolf, Greenfield & Sacks, P.C.

(57) ABSTRACT

A snowboard boot including at least one recess adapted to mate with a corresponding engagement member on a binding, and an interface for interfacing a snowboard boot to a binding. The interface comprises a body having at least one recess arranged to be disposed along an outer surface of the snowboard boot, the recess being adapted to mate with a corresponding engagement member on the binding. The interface may be molded of a non-metallic material and bonded to a snowboard boot.

129 Claims, 8 Drawing Sheets

U.S. PATENT DOCUMENTS

| | | | |
|---|---|---|---|
| 3,888,497 | A | 6/1975 | Zahradka |
| 3,900,204 | A | 8/1975 | Weber |
| 3,944,240 | A | 3/1976 | Bodendorfer |
| 3,957,280 | A | 5/1976 | Turnheim et al. |
| 3,972,134 | A | 8/1976 | Kastinger |
| 3,988,841 | A | 11/1976 | Salomon |
| 4,026,045 | A | 5/1977 | Druss |
| 4,042,257 | A | 8/1977 | Salomon |
| 4,155,179 | A | 5/1979 | Weninger |
| 4,177,584 | A | 12/1979 | Bevl |
| 4,182,525 | A | 1/1980 | Spademan |
| 4,270,770 | A | 6/1981 | Spademan |
| 4,352,508 | A | 10/1982 | Spademan |
| 4,387,517 | A | 6/1983 | Annovi |
| 4,395,055 | A | 7/1983 | Spademan |
| 4,403,785 | A | 9/1983 | Hottel |
| 4,492,387 | A | 1/1985 | Spademan |
| 4,542,599 | A | 9/1985 | Annovi |
| 4,570,363 | A | 2/1986 | Annovi |
| 4,652,007 | A | 3/1987 | Dennis |
| 4,669,202 | A | 6/1987 | Ottieri |
| 4,677,769 | A | 7/1987 | Ahmad et al. |
| 4,728,116 | A | 3/1988 | Hill |
| 4,741,550 | A | 5/1988 | Dennis |
| RE33,350 | E | 9/1990 | Stuart |
| 4,964,649 | A | 10/1990 | Chamberlin |
| 4,973,073 | A | 11/1990 | Raines et al. |
| 4,979,760 | A | 12/1990 | Derrah |
| 5,028,068 | A | 7/1991 | Donovan |
| 5,035,443 | A | 7/1991 | Kincheloe |
| 5,044,654 | A | 9/1991 | Meyer |
| 5,044,656 | A | 9/1991 | Peyre |
| 5,054,807 | A | 10/1991 | Fauvet |
| 5,069,463 | A | 12/1991 | Baud et al. |
| 5,085,455 | A | 2/1992 | Bogner et al. |
| 5,094,470 | A | 3/1992 | Riedel |
| 5,143,396 | A | 9/1992 | Shaanan et al. |
| 5,145,202 | A | 9/1992 | Miller |
| 5,172,924 | A | 12/1992 | Barci |
| 5,188,386 | A | 2/1993 | Schweizer |
| 5,232,241 | A | 8/1993 | Knott et al. |
| 5,236,216 | A | 8/1993 | Ratzek |
| 5,299,823 | A | 4/1994 | Glaser |
| 5,344,179 | A | 9/1994 | Fritschi et al. |
| 5,354,088 | A | 10/1994 | Vetter et al. |
| 5,397,141 | A | 3/1995 | Hoshizaki et al. |
| 5,401,041 | A | 3/1995 | Jespersen |
| 5,409,244 | A | 4/1995 | Young |
| 5,417,443 | A | 5/1995 | Blattner et al. |
| 5,474,322 | A | 12/1995 | Perkins et al. |
| 5,480,176 | A | 1/1996 | Sims |
| 5,499,461 | A | 3/1996 | Danezin et al. |
| 5,505,477 | A | 4/1996 | Turner et al. |
| 5,595,396 | A | 1/1997 | Bourdeau |
| 5,636,455 | A | 6/1997 | Meiselman |
| 5,664,344 | A | 9/1997 | Marmonier |
| 5,690,351 | A | 11/1997 | Karol |
| 5,722,680 | A | 3/1998 | Dodge |
| 5,755,046 | A | 5/1998 | Dodge |
| 5,875,566 | A * | 11/1999 | Bourdeau et al. ..... 36/12 |
| 5,975,556 | A * | 11/1999 | Lehmann ..... 280/624 |

FOREIGN PATENT DOCUMENTS

| | | |
|---|---|---|
| EP | 0838250 A1 | 4/1998 |
| FR | 2 628 981 | 9/1989 |
| FR | 2 644 074 | 9/1990 |
| FR | 2 652 753 | 4/1991 |
| FR | 2705248 | 5/1993 |
| FR | 2689 776 | 10/1993 |
| IT | 322456 | 12/1963 |
| JP | 46-17464 | 6/1971 |
| JP | 4-506613 | 11/1992 |
| JP | 6-296723 | 10/1994 |
| JP | 3004426 | 11/1994 |
| JP | 7-303728 | 11/1995 |
| JP | 3019932 | 1/1996 |
| WO | WO 90/11109 | 10/1990 |
| WO | WO 95/09035 | 4/1995 |
| WO | WO 96/05894 | 2/1996 |
| WO | WO96/26774 | 9/1996 |
| WO | WO 96/36407 | 11/1996 |
| WO | WO97/03734 | 2/1997 |
| WO | WO 97/04843 | 2/1997 |
| WO | WO 97/17860 | 5/1997 |

* cited by examiner

METHOD AND APPARATUS FOR INTERFACING A SNOWBOARD BOOT TO A BINDING

This application is a continuation of Ser. No. 08/584,053, filed Jan. 8, 1996, now U.S. Pat. No. 6,126,179, which is a continuation-in-part of Ser. No. 08/375,971 filed Jan. 20, 1995 abandoned.

BACKGROUND OF THE INVENTION

1. Field of the Invention

The present invention is directed to snowboarding, and more particularly, to a method and apparatus for interfacing a snowboard boot to a binding.

2. Discussion of the Related Art

Snowboarding is a newer sport than many alpine and nordic sports such as downhill and cross-country skiing, and presents different challenges for boots and bindings that attach the rider to the board. In contrast to most alpine and nordic sports, a snowboard rider stands with both feet on the board, and both are typically disposed at an angle relative to the longitudinal axis of the board. Thus, the stresses and forces generated by a snowboard rider are significantly different from those generated by a skier. As a result, conventional ski bindings are not satisfactory for use in connection with a snowboard. Thus, a number of boot and binding systems have been developed specifically for use in connection with snowboards.

It has been proposed to mount a plate or bar, typically metal, to the boot to provide an interface for engaging the binding. U.S. Pat. No. 5,299,823 (Glaser) is representative, disclosing a system including a plate that is mounted to the sole of the snowboard boot and that extends laterally from each side thereof to provide an interface for engaging the binding. This type of system suffers some disadvantages. First, the metal plate attached to the boot for interfacing with the binding has a tendency to attract snow and ice, which can clog the interface and make it difficult to lock the binding. Second, since the portion of the bindings that engage the boot are also typically formed from metal, a metal-to-metal contact is established between the boot and the binding, which does not absorb shock well and can result in a rough ride. Third, the use of a metal interface increases the weight of the boot. Finally, the metal interface can make the system more expensive, both in terms of the additional metal parts required, and the labor cost of incorporating the additional metal parts into the boot.

Many conventional snowboard boot and binding systems also suffer from a disadvantage in that they are not "step-in" systems, in that they require that a handle or lever be actuated after the rider's boot is placed into the binding to lock the binding in place. The requirement for actuating a mechanism to lock the binding is disadvantageous, in that it makes it less convenient and more time consuming to engage the rider's boots to the snowboard.

In view of the foregoing, it is an object of the present invention to provide an improved method and apparatus for interfacing a snowboard boot to a binding.

SUMMARY OF THE INVENTION

In one illustrative embodiment of the invention, an interface is provided for interfacing a snowboard boot to a binding. The interface comprises a body having at least one recess arranged to be disposed along an outer surface of the snowboard boot, the recess being adapted to mate with a corresponding engagement member on the binding.

In another illustrative embodiment of the invention, a snowboard boot is provided including at least one recess adapted to mate with a corresponding engagement member on a binding.

In a further illustrative embodiment of the invention, a snowboard boot assembly, is provided that comprises an upper boot portion, and means, bonded to the upper boot portion, for providing at least one recess for the boot assembly, the at least one recess being adapted to mate with a corresponding engagement member on a binding.

BRIEF DESCRIPTION OF THE DRAWINGS

The invention will be better understood and appreciated from the following detailed description of illustrative embodiments thereof, and the accompanying drawings, in which.

DETAILED DESCRIPTION

The present invention relates to a method and apparatus for interfacing a snowboard boot and binding. In accordance with the present invention, the snowboard boot is provided with at least one recess adapted to receive an engagement member from the binding. The recess can be formed entirely of non-metallic materials, such as elastomeric materials, to form a shock absorbing engagement between the boot and binding. Furthermore, by forming the boot recess of a non-metallic material, the likelihood of snow being attracted to and clogging the recess is reduced, and the interface between the boot and binding can be manufactured in an inexpensive manner. Additionally, the provision of recesses on the side of the boot assembly for engaging the binding, rather than protrusions extending therefrom facilitates the implementation of a step-in binding compatible therewith.

Figure 1:
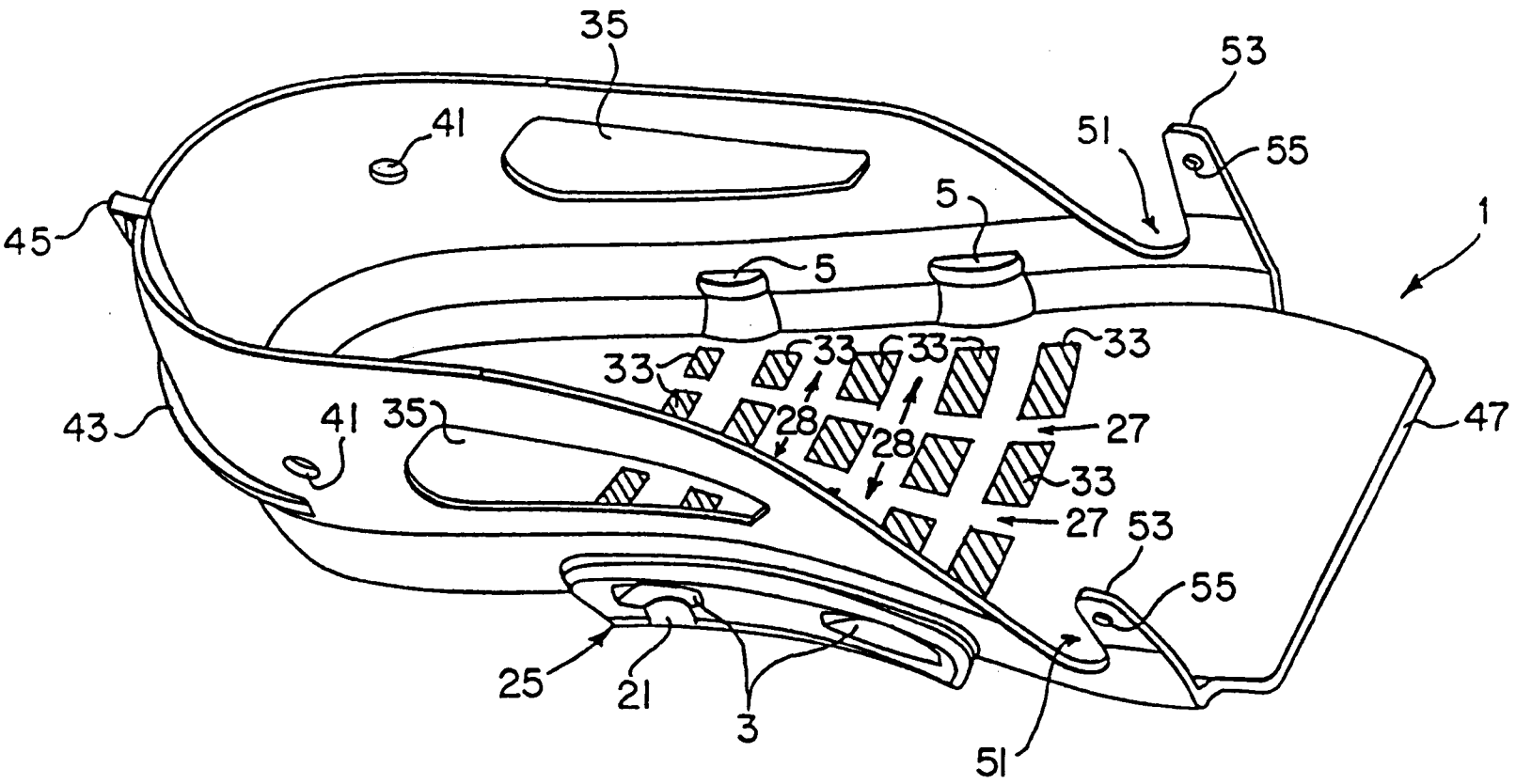
FIG. 1 is a top perspective view of a boot/binding interface in accordance with the present invention.

In accordance with one illustrative embodiment of the invention, an interface 1, shown in FIG. 1, is provided for interfacing the snowboard boot to a binding. The interface 1 is a single piece of a molded material. Any number of materials can be used, including elastomeric materials such as polyurethane, nylon and thermoplastic rubbers. The interface can be molded using any of a number of standard molding techniques, such as injection molding.

The interface 1 includes a pair of recesses 3 formed along each side thereof, with the recesses forming protrusions 5 along the inner walls of the interface. Each of the recesses 3 in the interface is adapted to engage one of a pair of engagement members (e.g., engagement fingers 13 shown in FIG. 5) on each side of a compatible binding, which is described in more detail below.

Figure 1A:
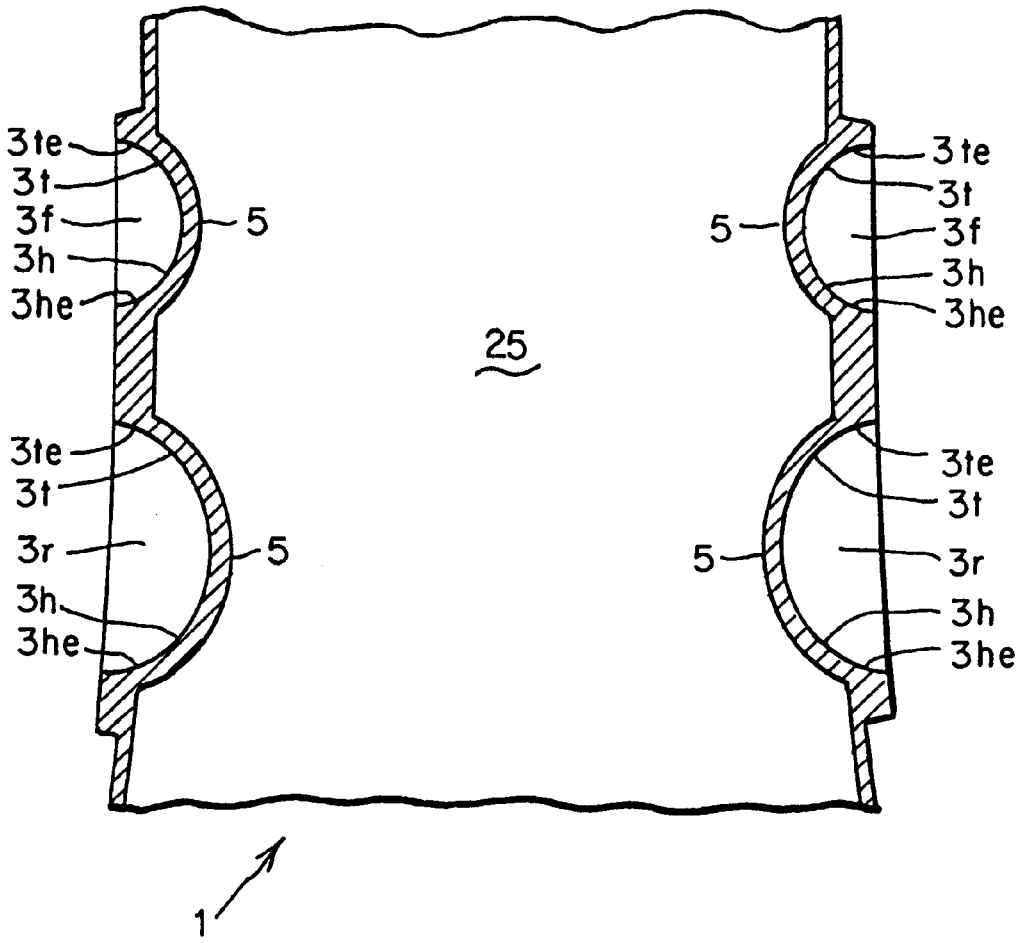
FIG. 1A is a partial cross-sectional top view of the interface showing the sidewalls of the recesses.

FIG. 1A shows a partial cross-sectional view of the recesses 3*f*, 3*r* shown from the top of the interface 1. Each recess 3*f*, 3*r* includes a toe-end sidewall 3*t* that closes a toe-facing edge 3*te* of the recess and a heel-end sidewall 3*h* that closes a heel-facing edge 3*he* of the recess. As shown in FIG. 1A, each of the toe-end sidewall 3*t* and the heel-end sidewall 3*h* may be curved. In addition, in the embodiment shown in FIG. 1A, the toe-end sidewall 3*t* and the heel-end sidewall 3*h* is formed as a single, continuous curved wall. However, as indicated below, it is to be appreciated that the recess is not limited to any particular configuration.

Figure 2:
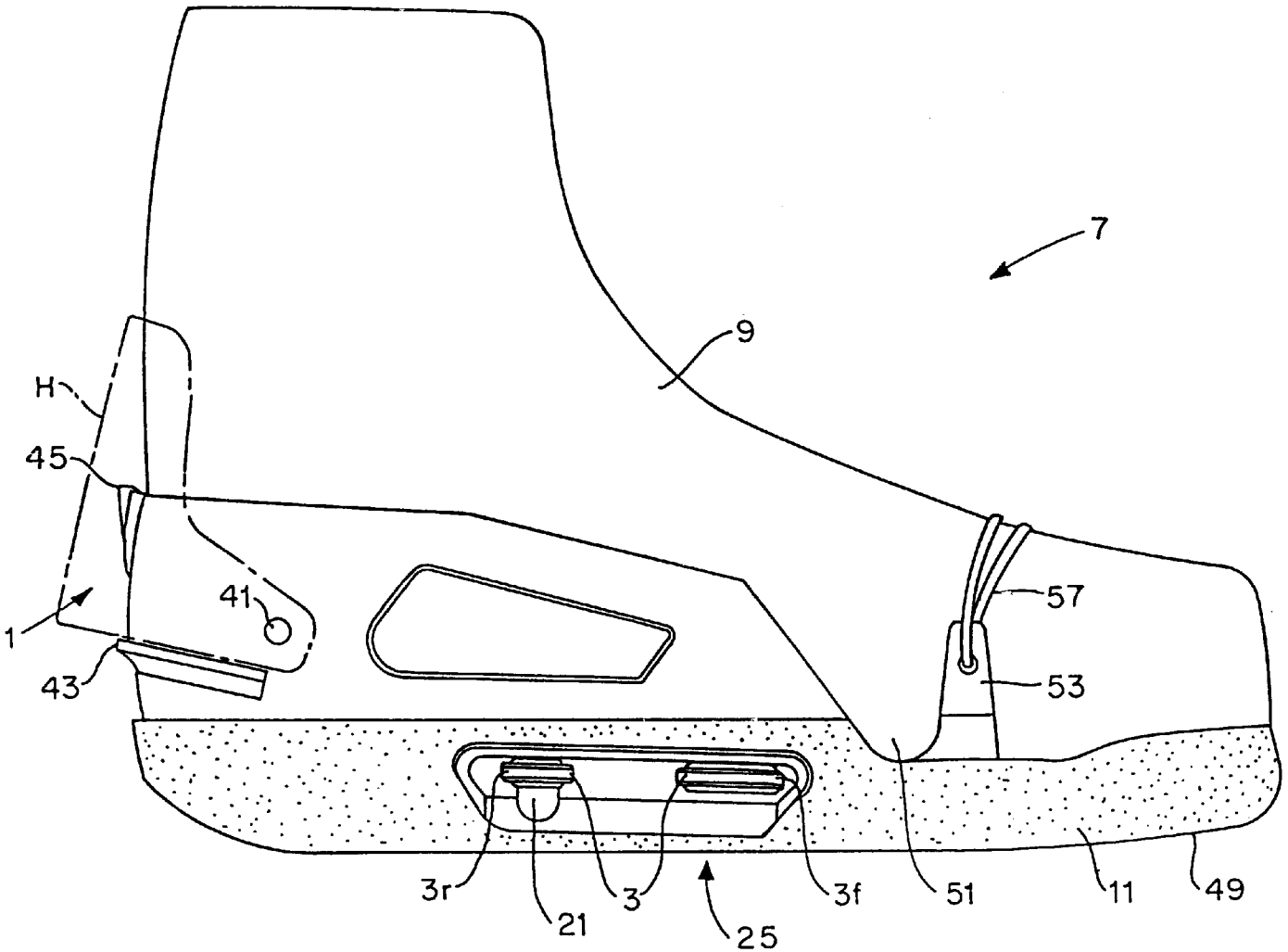
FIG. 2 is a side view of a boot assembly incorporating the interface of FIG. 1.

FIG. 2 shows a snowboard boot assembly 7 that includes the interface 1, and is formed according to a method described in detail below. In addition to the interface 1, the snowboard boot assembly 7 includes an upper boot portion 9 disposed within the interface, and a rubber sole 11 disposed below at least a portion of the interface 1. In the embodiment shown in FIG. 2, a single rubber sole 11 extends below the entire bottom surface of the interface 1 to provide traction when walking. However, in an alternate embodiment of the invention, two half-soles can be used, one underlying the forefoot and one underlying the heel area, with no rubber underlying the central section 25 of the interface.

Figure 5:
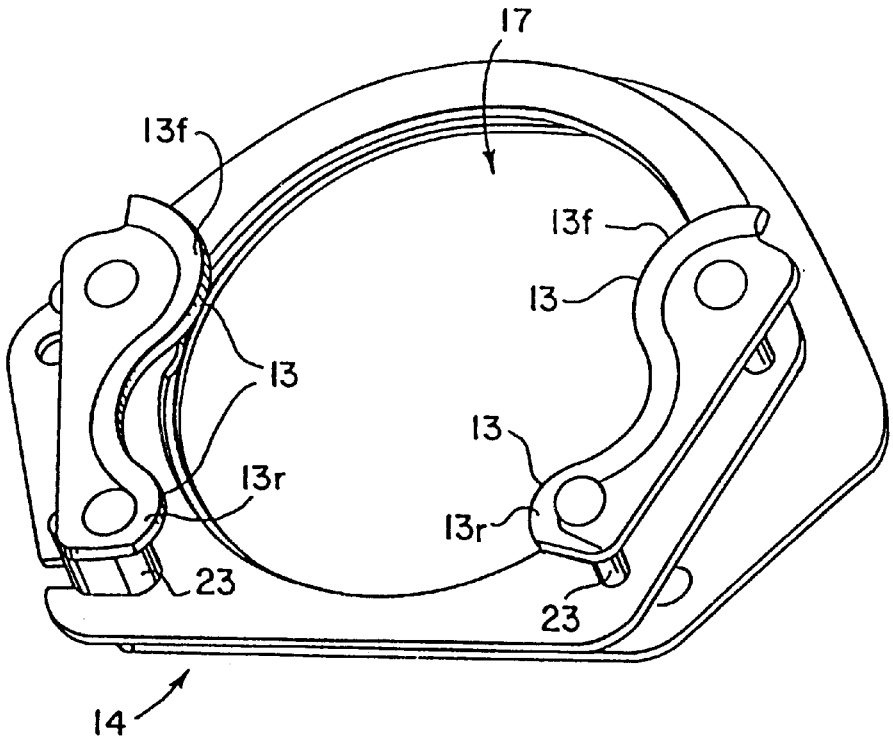
FIG. 5 is a perspective view of portions of a binding compatible with the interface and boot assembly of the present invention.

As should be appreciated from FIG. 2, once the snowboard boot assembly 7 is complete, the recesses 3 of the interface extend laterally along the side thereof and provide a point of attachment for a compatible binding such as the one shown in FIG. 5. In the embodiment shown in the figures, the interface 1 and the boot assembly 7 formed therefrom include a pair of recesses 3 disposed on each side. The use of multiple recesses on at least one side of the interface, rather than a single longer recess extending along each side thereof, provides a stronger engagement between the interface and the binding, because twice as many recess mouth corners are provided to resist forces that would tend to pry the recesses open. Furthermore, the two recesses also provide greater bearing surface to prevent front and back movement of the boot assembly within the binding.

Although the embodiment shown in the figures includes a pair of recesses 3 on each side of the boot assembly, the present invention is not limited to this configuration. More than two recesses can be provided on one side of the assembly, although more than two is not believed to be necessary. Alternatively, a single recess can be provided on one side of the boot assembly, such that a set of three recesses can be employed with one being disposed on one side of the assembly, and the other two being disposed on the other side. If only three recesses are employed, the one disposed alone on one side of the boot assembly can be positioned anywhere along the side of the boot from an in-line position opposite the rear recess 3*r* on the other side to an in-line position opposite the forward recess 3*f* on the other side. By positioning the three recesses in this manner, they define an engagement plane that stabilizes the boot assembly within the binding. Further, the clamping forces applied at the three recesses do not twist the boot assembly, which could cause it to come free of the binding. Furthermore, one or more of the recesses could be replaced with a different engagement surface along the interface 1 for engaging the binding.

Maximum stability would be provided by distributing the recesses 3 about the center of the length of the foot or boot, which is in the in-step area. However, feet of different sizes vary by a significantly greater amount in the forefoot, i.e., forward of the in-step area. Thus, in one embodiment of the invention, the forward recess 3*f* is not disposed forward of the in-step, so that a single interface 1 and a compatible binding can be used with boots of all different sizes. It has been found that positioning the forward recess at approximately the center of the length of the foot satisfactorily balances the goals of stabilizing the boot assembly in the binding, and enabling a single binding to be used with boots of all sizes.

As shown in the figures, the forward recess 3*f* (FIG. 2) is longer along the length of the boot assembly than the rear recess 3*r*. This difference is a function of the positioning of the recesses relative to the center of the length of the foot, and is done so that the boot assembly 7 (FIG. 2) will be compatible with a binding such as the one partially shown in FIG. 5, which illustrates the mechanical portions 14 of a binding for engaging the boot assembly. FIG. 5 does not illustrate a number of other portions of the binding, such as the actuation mechanism for moving the engagement fingers into and out of engagement with the boot assembly or a base cover plate that encloses the mechanics and is used in attaching the binding to the snowboard, because those aspects of the binding are not relevant to the present invention. The binding of FIG. 5 is attached to the snowboard via a hold-down disc (not shown) disposed in a central aperture in the base cover plate (similar to the base 52 of the binding of FIGS. 7–9 described below), which aligns with the aperture 17 in the mechanical portion of the binding shown in FIG. 5. The forward engagement fingers 13*f* in the binding are disposed across a wider portion of the central aperture 17 than the rear engagement fingers 13*r*, corresponding to a wider portion of the foot engaged by the forward engagement fingers 13*f*. Thus, the forward engagement fingers 13*f* have a larger radius than the rear engagement fingers. Consequently, to accommodate the larger forward engagement fingers 13*f*, the forward recesses 3*f* in the interface 1 are longer than the rear recesses 3*r*.

As will be appreciated from the discussion of the binding below, the locking fingers 13 are moved horizontally into engagement with the snowboard boot assembly of the present invention. Therefore, the mouth of each recess 3 is wider than its corresponding engagement finger 13, and is tapered to facilitate engagement between the binding and the boot assembly. In particular, snow and ice can accumulate between the snowboard boot and the board, so that when the rider's foot is placed into the binding, the recesses 3 may not be aligned perfectly level with the engagement fingers 13. If the recess mouths were the same width as the engagement fingers, a slight accumulation of snow could prevent the binding fingers from aligning with the recesses in the interface 1. By making the mouth of each recess wider than its corresponding engagement finger 13, they can be easily aligned even when snow has accumulated between the boot and the snowboard.

Figure 6:
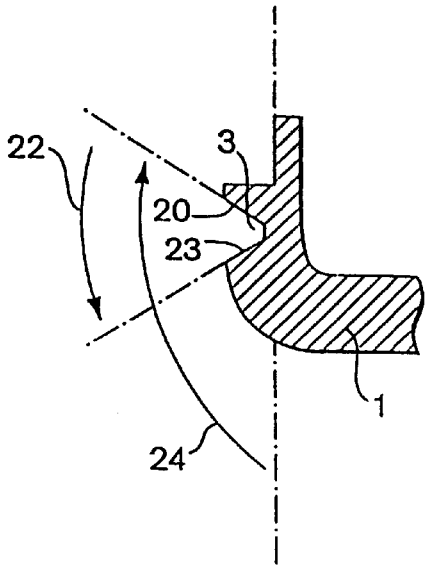
FIG. 6 is a partial cross-sectional view of the interface of FIG. 1 showing the angle of recesses formed therein.

As discussed below, the recesses 3, like the entire interface 1, is formed from an elastomeric material, which reduces the likelihood of snow accumulating therein as compared to metal interface systems. Nevertheless, snow and ice may at times accumulate within the recesses 3. Therefore, the walls of each of the recesses are tapered as shown in FIG. 6, which is a partial cross-sectional view of the interface 1. As shown in FIG. 6, the upper recess wall 20 is tapered upwardly at an angle 22 from vertical, and the lower wall 23 is tapered downwardly at an angle 24 from vertical. Thus, when the engagement fingers 13 are moved horizontally into engagement with the recesses 3, the tapered walls cause any snow and ice accumulated within the recess to be cammed out therefrom to securely lock the boot assembly into the binding. The angle of the recess walls should be sufficiently large to facilitate alignment with the engagement fingers, but should not be so large that they reduce the effectiveness of the recess in engaging the engagement fingers and allow the fingers to easily slip therefrom. Thus, each of these angles is preferably in a range of 95–135 degrees, with an angle of 105 degrees having been found to work effectively.

In the embodiment of the invention shown in FIGS. 1–4, each side of the interface 1 also includes a vertically extending recess 21 disposed immediately below the rear laterally extending recess 3*r*. The recesses 21 are adapted to mate with posts 23 (FIG. 5) disposed on opposite sides of a compatible binding below the rear engagement fingers 13*r*, and serve two purposes. First, when the rider's foot is placed into the binding prior to locking, engagement between the posts 23 and recesses 21 provides a snap-fit type of engagement that signifies that the boot is properly oriented for locking, which facilitates proper orientation during locking of the binding. Second, engagement between the posts 23 and recesses 21 assists in preventing forward and backward movement of the boot assembly relative to the binding when locked. It should be appreciated that many other types of mating features on the interface and binding can alternatively be used for the same purposes. Furthermore, although the provision of such features provides the advantages described above, it is not necessary to practice the present invention, and need not be provided in all embodiments of the invention.

The central section 25 of the interface 1 wherein the recesses 3 are provided to engage the binding may be the portion of the interface that is subjected to the greatest stress, and may therefore be strengthened and stiffened. In one embodiment of the invention, an aluminum plate (not shown) is provided inside the central section 25. As discussed above, the interface 1 can be formed through an injection molding process. When an aluminum plate is to be provided, the plate is inserted into the mold, is held in place by a number of pins disposed therein, and then the elastomeric material of the interface is injected into the mold.

Figure 4:
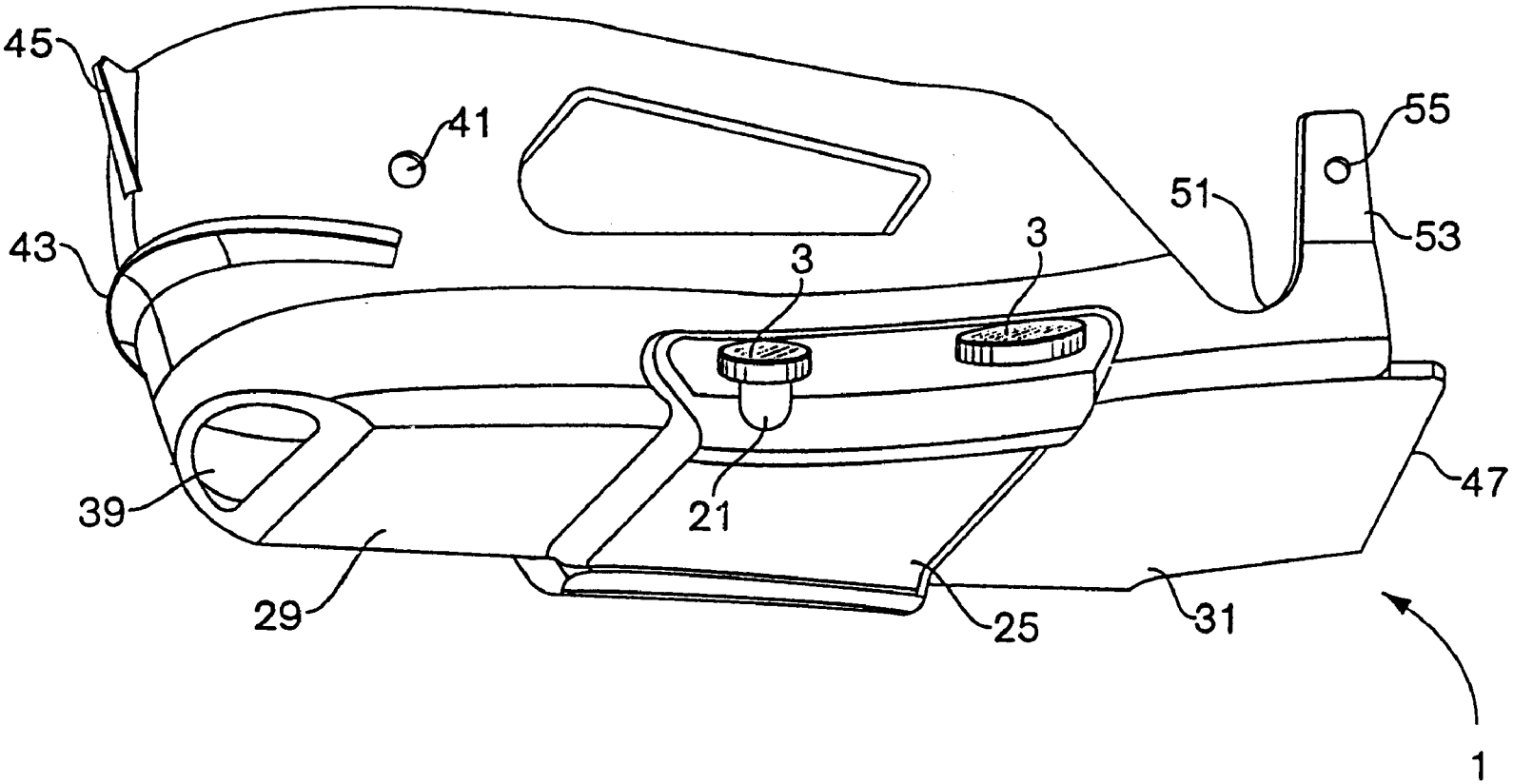
FIG. 4 is a bottom perspective view of the interface of FIG. 1.

In an alternate embodiment of the invention shown in FIG. 1, a grid of ribs (including longitudinal ribs 27 and lateral ribs 28) is provided along the inner surface of the central section 25 of the interface to stiffen it. As shown in FIG. 4, the central section 25 of the interface 1 protrudes not only outwardly beyond the lateral sides of the interface, but also below the heel and forward areas 29 and 31 of the interface. The ribs 27, 28 are separated by a plurality of grooves 33. Thus, the ribs 27, 28 strengthen and stiffen the central section 25 of the interface, while maintaining the walls in this area at substantially the same thickness as the remainder of the interface 1, which is advantageous in preventing warping and deformation when the interface is cooled after the injection molding process.

In another embodiment of the invention, an aluminum insert as discussed above is used in addition to ribs to strengthen and stiffen the central section 25 of the interface.

In the embodiment shown in the figures, the recesses are aligned so that they are substantially in-line with the lateral sidewalls of the interface. Thus, the principal load exerted on the interface 1 is a shear force, such that no substantial bending forces or torque is exerted thereon as would be generated if, for example, the recesses were located underneath the interface near the middle of the bottom surface. This is advantageous because the interface can be formed sufficiently strong to withstand the generated shear forces with less material than would be required to handle comparable bending forces or torque. In this respect, the interface is molded to have a wall thickness ranging from approximately 2–5 mm, with the thickness is most structural areas being approximately 4 mm.

Although the alignment of the recesses so that they are substantially in-line with the lateral sidewalls of the interface is advantageous, the invention is not limited to this configuration. For example, the recesses can alternatively be positioned underneath the interface or at the front and rear thereof, and the relevant portions of the interface can simply be stiffened and strengthened to withstand the forces and stresses that would be exerted thereon.

Each lateral side of the interface 1 can be provided with a window 35, which is an open area along the side of the interface. The windows soften the torsional stiffness along the lateral edges of the interface. By varying the shape of the windows 35, the stiffness along the edges of the interface can be controlled. In an alternative embodiment of the present invention not shown in the drawings, the upper side walls of the interface can be removed entirely, such that the sidewalls can extend along the lateral edges of the interface at approximately the lower level of the windows 35 shown in the drawings. In both embodiments, the heel portion of the interface is solid (i.e., no window is provided) and extends upwardly to provide a relatively large bonding surface for bonding the upper portion of the boot to the interface in the manner described below. It is desirable to provide a strong bond between the heel of the boot and the interface because significant upward force is applied at the heel portion of the interface in use.

Figure 3:
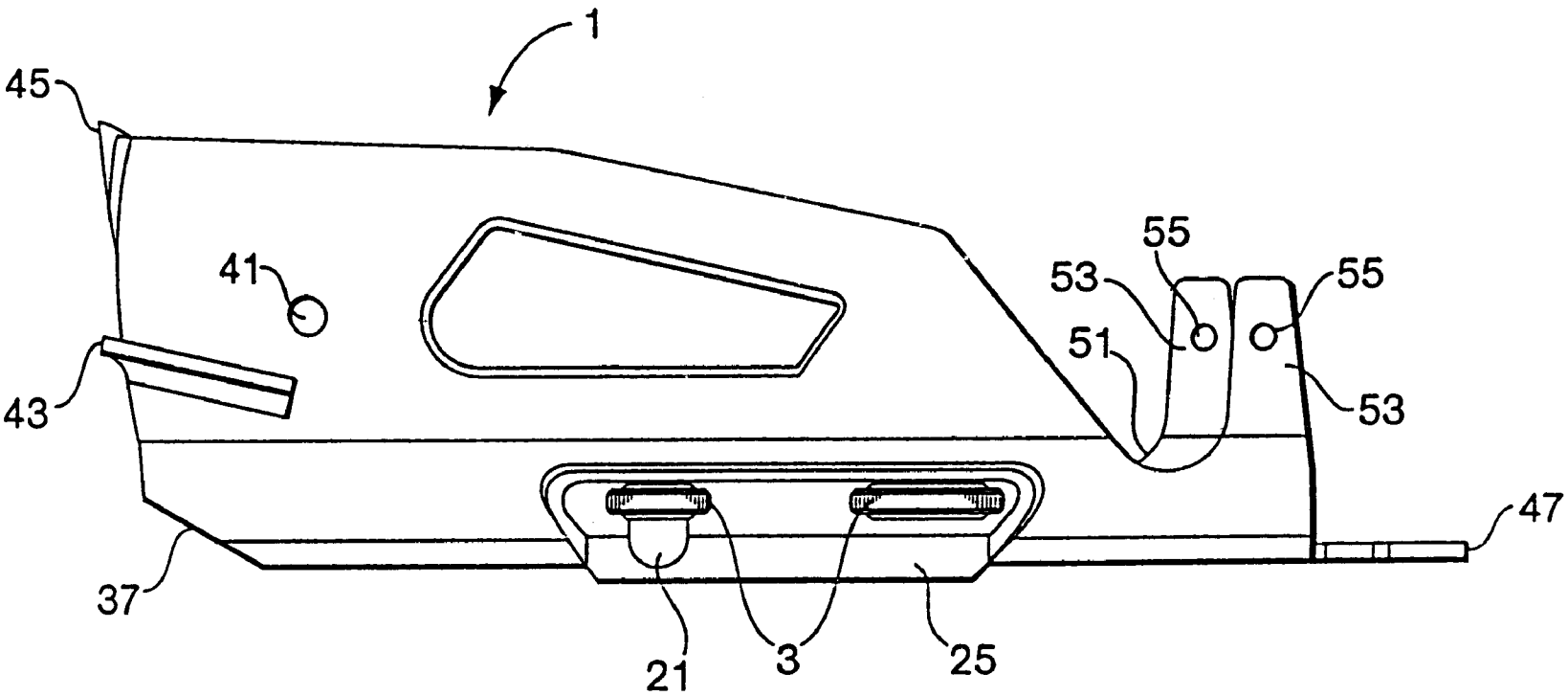
FIG. 3 is a side view of the interface of FIG. 1.

As shown in FIG. 3, the heel portion of the interface is beveled at 37 at an angle of approximately 15–60 degrees, which is advantageous in preventing a rider's heel from dragging when riding. The bevel is molded into the interface and affects only the outer contour of the heel portion of the interface, so that the bevel cannot be felt by the rider on the inner surface. However, since the bevel intersects the interior surface of the interface, an opening 39 (FIG. 4) results in the interface 1. A bevel angle of approximately 40 degrees has been found to work satisfactorily.

In one embodiment of the invention, the interface 1 is provided with several features to make it compatible with a hi-back support (H, shown in phantom in FIG. 2) that provides the rider with increased leverage in getting on the heel edge of the board. Each side of the heel portion of the interface is provided with an aperture 41 that mates with a corresponding aperture in the hi-back, and receives a screw or pin for connecting the two components. The apertures 41 may be molded into the interface 1, or may be punched therethrough after molding. The interface further includes a lateral shelf 43 extending around the back of the heel area. The shelf 43 is adapted to support the bottom of the hi-back. Finally, the heel portion of the interface can also include a vertically extending ridge 45 that extends above the top rim of the heel portion of the interface. The ridge 45 is adapted to engage a ledge along the inner surface of the hi-back to provide additional support thereto. Although the features of the disclosed embodiment to facilitate use of a high-back support provide certain advantages, it should be understood that they are not necessary to practice the present invention, and that some or all of these features need not be provided in all embodiments of the invention.

As shown best in FIGS. 1 and 4, the sole portion of the interface 1 terminates at 47 rearwardly of the toe area. Thus, when the interface 1 is incorporated into a completed snowboard boot assembly 7, the area 49 (FIG. 2) underlying the toes is formed solely from the flexible rubber sole 11. As a result, the entire sole of the boot assembly is not stiff like a ski boot, enabling the rider to walk more comfortably. A flex notch 51 can also be provided in the lateral walls of the interface 1 at approximately the ball of the foot to facilitate bending of the interface when the rider walks.

In the embodiment of the invention shown in the figures, the interface is further provided with a molded strap 53 on each side thereof near the forward edge of the interface. Each strap 53 includes an aperture 55 that enables a shoe lace 57 (FIG. 2) or strap to be threaded therethrough. The shoe lace and the molded straps 53 assist in holding down the toes when the rider leans back on the heel edge of the board. Although the straps 53 provide this advantage, it should be understood that they are not essential to practice the present invention.

The method of forming the snowboard boot assembly of the present invention will now be described. As discussed above, the interface 1 can be molded from an elastomeric material (e.g., polyurethane, nylon or a thermoplastic rubber). The upper portion 9 of the boot assembly is stitched, from leather and other conventional boot materials, to form a slipover using conventional boot-making techniques. The slipover is essentially the upper portion of a boot, without a bottom sole, that has not yet been formed into the shape of a boot. The slipover is then lasted, i.e., is pulled over a last which is a form shaped like a foot, to form the slipover into a boot shape. A brand sole, which is a thin foot-shaped section of material such as cardboard, plastic or fabric, is then bonded to the slipover using any of a number of conventional boot-making techniques, such as glueing, stitching or tacking. The interface 1 is then bonded over the combined slipover and brand sole using contact cement disposed therebetween, and/or by stitching. Finally, the rubber sole 11 is bonded to the outside of the interface using contact cement. Some areas of the sole can also be stitched for reinforcement, although this is not necessary. The rubber sole provides traction for the rider when walking in the boot assembly. After the boot assembly is completed, a cushioning foot bed and liner are inserted inside the boot in a conventional fashion.

As discussed above, the recesses 3 on the interface 1 are adapted to engage with compatible engagement members (e.g., locking fingers 13) on a binding such as the one shown in FIG. 5. The recesses can be formed in any number of configurations to mate with compatible binding engagement members, and it should be understood that the present invention is not limited to the particular recess and engagement finger configuration shown in the figures. Furthermore, the present invention is directed to the interface 1 and snowboard boot assembly incorporating it, and is not limited to any particular type of binding arrangement. Thus, the discussion above relating to the binding 14 of FIG. 5 has been limited to the nature of the engagement fingers and the posts 23, because the remainder of the binding is irrelevant to the present invention. The boot assembly of the present invention can be used with any binding having compatible engagement fingers, irrespective of the actuation mechanism used to bring the engagement members into and out of engagement with the boot assembly. However, for the sake of illustration, an exemplary binding mechanism that can be used with the snowboard boot assembly of the present invention is described below. This binding is identical in most respects to the binding disclosed in the applicant's commonly assigned U.S. patent application Ser. No. 08/375, 971, but the locking fingers have been modified to be compatible with the recesses 3 in the interface 1 of the present invention.

Figure 7:
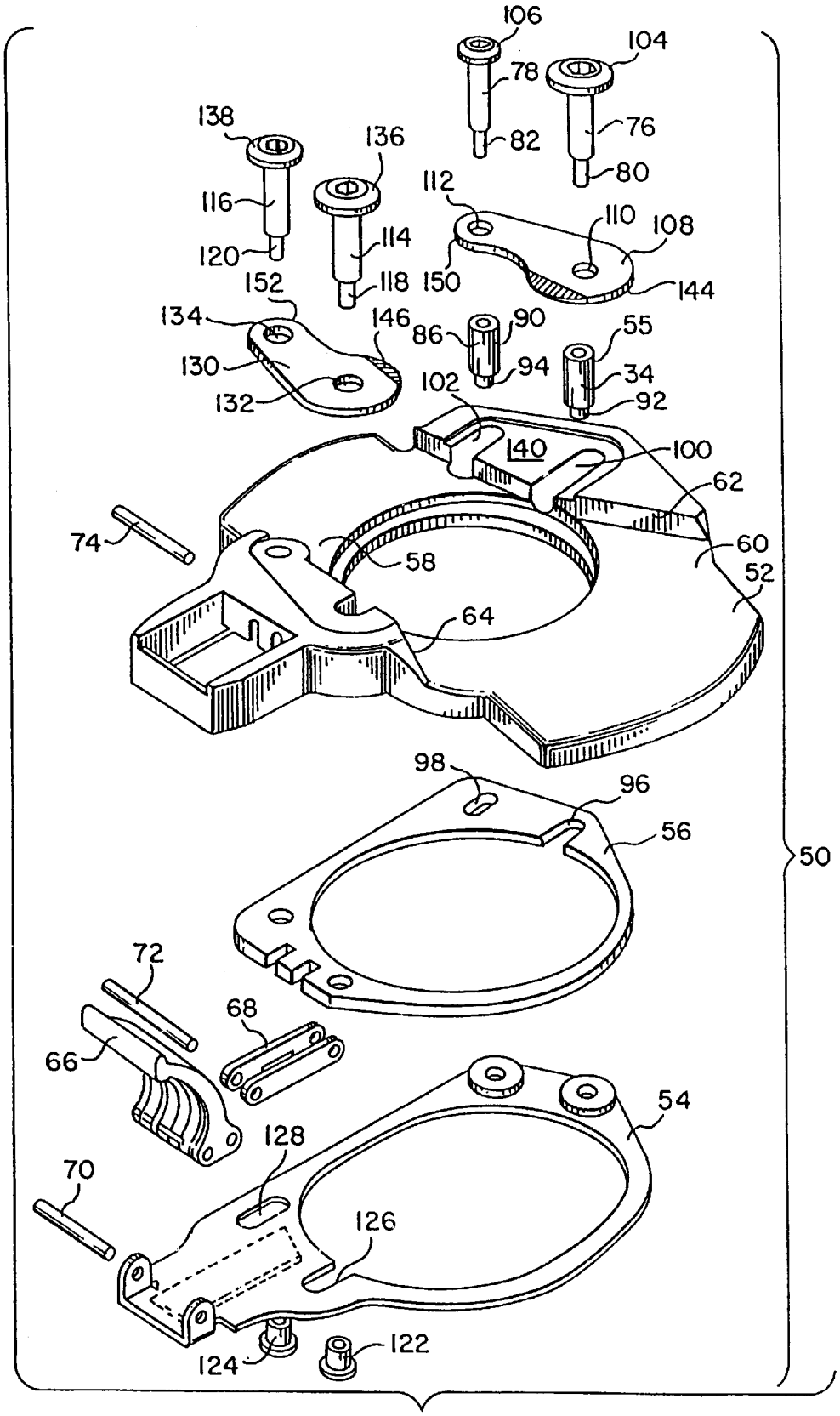
FIG. 7 is an exploded view of a binding compatible with the interface and boot assembly of the present invention.
Figure 8:
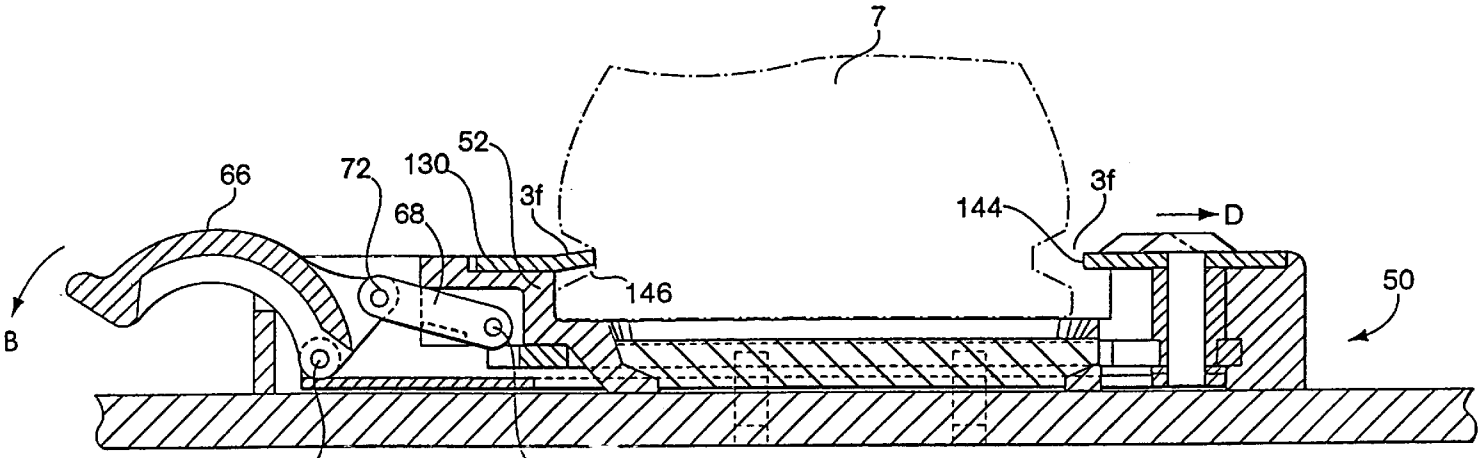
FIG. 8 is a cross-sectional view of the binding of FIG. 7 in an open configuration with a boot assembly of the present invention inserted therein.
Figure 9:
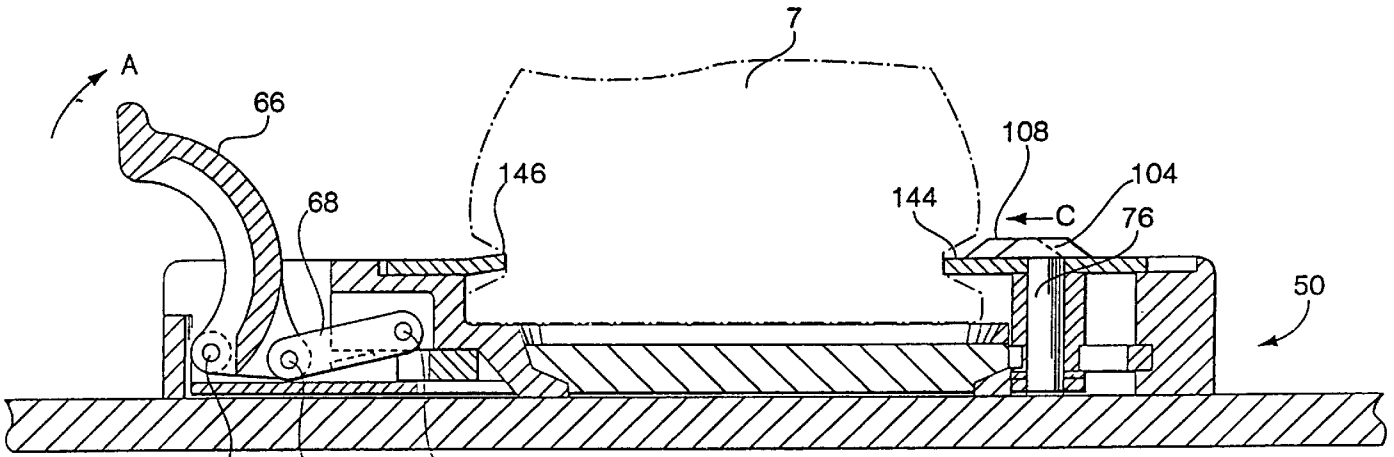
FIG. 9 is a cross-sectional view of the binding of FIG. 7 in a closed configuration engaging a boot assembly of the present invention.

The exemplary binding is disclosed in FIGS. 7–9. The binding 50 includes a base 52, a sliding plate 54 and a fixed plate 56. The base 52 has a recessed channel 58, including an upper surface 60 and two sidewall surfaces 62, 64, to receive a snowboard boot such as the boot assembly 7 (FIG. 2) of the present invention. The sliding plate 54 is slidably attached to base 52 through a pivoting handle 66 and link 68. A pin 70 is used to pivotally connect the handle 66 to the sliding plate 54. A second pin 72 is used to pivotally connect the handle 66 to one end of link 68, with the opposite end of link 68 being pivotally connected to the base 52 via third pin 74.

A first pair of engagement rods 76, 78 is fixedly attached to sliding plate 54 at their lower ends 80, 82 by riveting or other suitable means. Rods 76 and 78 respectively pass through spacer sleeves 84, 86 that have stepped outer diameters including larger diameter portions 88, 90 and smaller diameter portions 92, 94. The smaller diameter portions 92, 94 are respectively received in elongated slots 96, 98 in the fixed plate 56, and the larger diameter portions 88, 90 are respectively received in elongated slots 100, 102 in the base member 52. The upper axially ends of the rods 76, 78 respectively have head or plate-shaped portions 104, 106.

An engagement plate 108 receives the larger diameter portion of rods 76, 78 through a pair of holes 110, 112, with the engagement plate being disposed between the head portions 104, 106 and spacer sleeves 84, 86. The spacer sleeves absorb some of the bending forces that may be applied against rods 76, 78. Additionally, the engagement plate 108 assists in transferring some of the bending forces that may be applied to rods 76, 78 into tensile forces extending axially through the rods.

A second pair of engagement rods 114, 116 is fixedly attached to the fixed plate 56 in a manner similar to that in which the first pair of engagement rods 76, 78 is fixedly attached to the sliding plate 54. The pairs of engagement rods can be fixedly attached to the plates by a press fit, welding, shrink-fitting, or some other suitable means. The lower ends 118, 120 of the second pair of engagement rods 114, 116 have reduced diameter portions that are sized to fit within a pair of shoulder bushings 122, 124. The shoulder bushings 122, 124 are respectively received in elongated slots 126, 128 in the sliding plate 54 to help guide a sliding motion thereof. A second engagement plate 130 is mounted about the second pair of engagement rods 114, 116 via their respective through bores 132, 134. Engagement plate 130 is mounted just below heads 136, 138 of the engagement rods 114, 116, respectively.

Engagement plate 108 is slidably supported on a slightly recessed, substantially planer surface 140 in the base member 52, and engagement plate 130 is slidably supported on a slightly recessed, substantially planer support surface 142. Plates 108 and 130 also have beveled edge portions 144, 146 that act as locking fingers that engage the forward recesses **3*f* (FIG. 2) in the interface 1 of the boot assembly of the present invention. Although not depicted as such in FIG. 7, the rear portions of the plates 108, 130 that act as rear locking fingers may similarly be beveled to engage the rear recesses 3*r* in the interface 1. An example of beveled locking fingers is shown in the binding of FIG. 5**.

As illustrated in FIGS. 8 and 9, the beveled portions 144 and 146 of engagement plates 108, 130 can be selectively engaged with the forward recesses 3*f* in the interface 1 to lock the boot assembly in the binding.

The operation of the boot binding mechanism is described making reference to FIGS. 7–9. A rider wearing the snowboard boot assembly 7 according to an embodiment of the present invention steps in the open binding and positions the recesses 3 on one side thereof into the engaged position with the locking fingers 144, 150 of the engagement plate 130 as illustrated in FIGS. 8 and 9. As mentioned above, the snap-fit engagement between the recess 21 (FIG. 2) and posts 23 (FIG. 5) facilitate proper orientation of the boot in the binding. To lock the boot in the binding, the rider pulls upwardly on the handle 66 which causes the handle to rotate in the direction indicated by arrow A in FIG. 9. Rotation of the handle in this direction causes the link 68 to pivot in the opposite direction (shown by arrow B) about fixed pin 74. Continued rotation of the handle 66 slides the pivot pin 70 in the direction indicated by arrow C, causing the sliding plate 54 and its engagement fingers 144, 150 to slide in the same direction from the open position illustrated in FIG. 8 to the closed position illustrated in FIG. 9, where the engagement fingers on both sides of the binding engage the recesses 3 in the interface 1. When pin 72 passes over an imaginary line extending between pins 70 and 74, the handle reaches what is known as a centered position, in which it is unstable and will tend to snap into the closed position illustrated in FIG. 9. In the closed position, the handle is in an over-centered position, wherein compression forces generated by the boot along link 68 act to rotate the handle about pin 70 in the direction of arrow A to keep the binding closed. Thus, the binding will not inadvertently open during riding.

To unlock the binding, the rider simply pushes down and rotates the handle 66 in the direction indicated by arrow B in FIG. 8, which moves the handle out of the over-centered position. Because of the linkage mechanism, rotation of the handle 66 in this direction causes the plate 54 and engagement fingers 144, 150 to slide in the direction indicated by arrow D to the open position illustrated in FIG. 8, enabling the rider to simply step out of the binding.

Although the illustrative binding shown in FIGS. 7–9 does not include a step-in feature, the snowboard boot assembly of the present invention is also compatible with such a system.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. A snowboard boot, comprising:

an upper;

a sole having a first stiffness;

an interface, attached to the sole, to interface the snowboard boot to a binding, the interface having a second stiffness that is stiffer than the first stiffness, the interface comprising first and second opening peripheries respectively defining first and second openings disposed on a same side of the snowboard boot, each of the first and second openings being adapted to receive a corresponding binding engagement member on the binding, each one of the first and second openings being disposed at approximately an instep area of the snowboard boot and having a toe-end sidewall that closes a toe-facing edge of the one of the openings and a heel-end sidewall that closes a heel-facing edge of the one of the openings; and wherein the sole comprises an inner sole and a rubber outer sole, and wherein a portion of the interface is disposed between the inner sole and the rubber outer sole.

2. The snowboard boot of claim 1, wherein the first and second opening peripheries are disposed substantially in-line with a sidewall of the snowboard boot upper.

3. The snowboard boot of claim 1, in combination with the binding, wherein the binding comprises an engagement member having first and second locking fingers that engage within the first and second openings, respectively, when the binding is in a closed position.

4. The snowboard boot of claim 1, wherein the rubber outer sole comprises at least two physically separate and distinct outer sole portions that are not part of a unitary outer sole, the at least two outer sole portions comprising a first outer sole portion being adapted to underlie a heel area of the boot and a second outer sole portion being adapted to underlie a forefoot area of the boot.

5. The snowboard boot of claim 4, wherein the first and second outer sole portions are separated so that neither underlies a central section of the interface disposed in an instep area of the snowboard boot.

6. The snowboard boot of claim 5, wherein the rubber outer sole comprises a gap so that no portion of the rubber outer sole underlies the central section of the interface disposed in the instep area of the snowboard boot.

7. The snowboard boot of claim 1, wherein the first and second openings are disposed on opposite sides of a center of a length of the snowboard boot.

8. The snowboard boot of claim 1, wherein each of the first and second openings has a top wall, a bottom wall and a width extending between the top and bottom walls, and wherein the width of each of the first and second openings is greater than its corresponding binding engagement member to facilitate engagement between the first and second openings and their corresponding binding engagement members.

9. The snowboard boot of claim 1, wherein each of the toe-end sidewalls and the heel-end sidewalls is curved.

10. The snowboard boot of claim 2, wherein the sole comprises an inner sole and a rubber outer sole, and wherein a portion of the interface is disposed between the inner sole and the rubber outer sole.

11. The snowboard boot of claim 1, wherein a forward one of the first and second openings is disposed at approximately a center of a length of the snowboard boot.

12. The snowboard boot of claim 1, wherein each of the first and second openings is constructed and arranged so that when the corresponding binding engagement members move into mating engagement with the first and second openings, any snow contained in the first and second openings is cammed out therefrom.

13. The snowboard boot of claim 10, wherein each of the toe-end sidewalls and the heel-end sidewalls is curved.

14. The snowboard boot of claim 1, wherein a region of the snowboard boot wherein the interface comprises the first and second openings is stiffer than a forefoot region of the snowboard boot.

15. The snowboard boot of claim 1, wherein the interface further comprises an alignment feature adapted to engage with a corresponding feature in the binding when the first and second openings are aligned with their corresponding binding engagement members.

16. The snowboard boot of claim 15, wherein the alignment feature is an additional opening in the interface adapted to receive the corresponding feature in the binding.

17. The snowboard boot of claim 1, wherein the first and second openings are arranged on the interface so that when the first and second openings engage their corresponding binding engagement members, a principle load generated on the interface is a shear force.

18. The snowboard boot of claim 1, wherein the interface terminates rearwardly of a toe area of the snowboard boot so that the interface does not underlie the toe area of the snowboard boot.

19. The snowboard boot of claim 1, wherein the sole has a toe area adapted to underlie the toes of a wearer's foot, and wherein the sole is flexible in the toe area.

20. The snowboard boot of claim 1, wherein the snowboard boot is free of any attachment feature, adapted to engage with the binding, that is disposed forward of the in-step area.

21. The snowboard boot of claim 1, wherein the snowboard boot comprises a metal plate disposed in an instep area of the snowboard boot.

22. The snowboard boot of claim 21, wherein the metal plate terminates rearwardly of a toe area of the snowboard boot so that the metal plate does not underlie the toe area of the snowboard boot.

23. The snowboard boot of claim 21, wherein the interface comprises the metal plate.

24. The snowboard boot of claim 1, in combination with the binding.

25. The snowboard boot of claim 1, wherein the interface is formed of a non-metallic material.

26. The snowboard boot of claim 1, wherein the interface is a single molded piece.

27. The snowboard boot of claim 1, wherein the interface further comprises at least one additional opening disposed on a side of the snowboard boot opposite the same side on which the first and second openings are disposed.

28. The snowboard boot of claim 1, wherein the side of the snowboard boot on which the first and second openings are disposed is an inside of the snowboard boot.

29. The snowboard boot of claim 1, wherein the side of the snowboard boot on which the first and second openings are disposed is an outside of the snowboard boot.

30. The snowboard boot of claim 2, wherein the interface further comprises an alignment feature adapted to engage with a corresponding feature in the binding when the first and second openings are aligned with their corresponding binding engagement members, and wherein the alignment feature is an additional opening in the interface adapted to receive the corresponding feature in the binding.

31. The snowboard boot of claim 30, wherein the sole has a toe area adapted to underlie the toes of a wearer's foot, and wherein the sole is flexible in the toe area.

32. The snowboard boot of claim 31, wherein the snowboard boot is free of any attachment feature, adapted to engage with the binding, that is disposed forward of the in-step area.

33. The snowboard boot of claim 31, wherein the snowboard boot comprises a metal plate disposed in an instep area of the snowboard boot, and wherein the interface comprises the metal plate.

34. The snowboard boot of claim 31, wherein the sole comprises an inner sole and a rubber outer sole, and wherein a portion of the interface is disposed between the inner sole and the rubber outer sole.

35. The snowboard boot of claim 19, wherein the interface further comprises an alignment feature adapted to engage with a corresponding feature in the binding when the first and second openings are aligned with their corresponding binding engagement members, and wherein the alignment feature is an additional opening in the interface adapted to receive the corresponding feature in the binding.

36. The snowboard boot of claim 19, wherein the snowboard boot is free of any attachment feature, adapted to engage with the binding, that is disposed forward of the in-step area.

37. The snowboard boot of claim 19, wherein the snowboard boot comprises a metal plate disposed in an instep area of the snowboard boot, and wherein the interface comprises the metal plate.

38. The snowboard boot of claim 19, wherein the sole comprises an inner sole and a rubber outer sole, and wherein a portion of the interface is disposed between the inner sole and the rubber outer sole.

39. The snowboard boot of claim 19, wherein each of the toe-end sidewalls and the heel-end sidewalls is curved.

40. The snowboard boot of claim 14, wherein a region of the snowboard boot wherein the interface comprises the first and second openings is stiffer than a forefoot region of the snowboard boot.

41. The snowboard boot of claim 40, wherein the snowboard boot comprises a metal plate disposed in an instep area of the snowboard boot, and wherein the interface comprises the metal plate.

42. The snowboard boot of claim 19, wherein the first and second opening peripheries are disposed substantially in-line with a sidewall of the snowboard boot upper.

43. The snowboard boot of claim 1, wherein the first and second opening peripheries are disposed substantially in-line with a sidewall of the snowboard boot upper;

wherein the sole comprises an inner sole and a rubber outer sole, wherein a portion of the interface is disposed between the inner sole and the rubber outer sole;

wherein each of the toe-end sidewalls and the heel-end sidewalls is curved;

wherein a region of the snowboard boot wherein the interface comprises the first and second openings is stiffer than a forefoot region of the snowboard boot;

wherein the interface further comprises an alignment feature adapted to engage with a corresponding feature in the binding when the first and second openings are aligned with their corresponding binding engagement members, the alignment feature being an additional opening in the interface adapted to receive the corresponding feature in the binding;

wherein the snowboard boot is free of any attachment feature, adapted to engage with the binding, that is disposed forward of the in-step area; and wherein the interface comprises a metal plate disposed in an instep area of the snowboard boot.

44. The snowboard boot of claim 43, in combination with the binding.

45. A snowboard boot, comprising:

a stitched upper;

a sole comprising an inner sole and a rubber outer sole; and an interface, attached to the sole, to interface the snowboard boot to a binding, the interface comprising:

first and second opening peripheries respectively defining first and second openings disposed on a same side of the snowboard boot, each of the first and second openings being adapted to receive a corresponding binding engagement member on the binding, each one of the first and second openings being disposed at approximately an instep area of the snowboard boot and having a toe-end sidewall that closes a toe-facing edge of the one of the openings and a heel-end sidewall that closes a heel-facing edge of the one of the openings; and an alignment feature adapted to engage with a corresponding feature in the binding, the alignment feature being an additional opening in the interface adapted to receive the corresponding feature in the binding;

wherein a region of the snowboard boot wherein the interface comprises the first and second openings is stiffer than a forefoot region of the snowboard boot; and wherein the snowboard boot is free of any attachment feature, adapted to engage with the binding, that is disposed forward of the in-step area.

46. The snowboard boot of claim 45, in combination with the binding.

47. The snowboard boot of claim 45, wherein the interface comprises a metal plate disposed in an instep area of the snowboard boot, wherein each of the toe-end sidewalls and the heel-end sidewalls is curved, and wherein each of the first and second opening peripheries is disposed substantially in-line with a sidewall of the snowboard boot upper.

48. The snowboard boot of claim 45, in combination with the binding, wherein the binding comprises an engagement member having first and second locking fingers and a corresponding alignment feature that engages with the alignment feature on the boot when the first and second openings are aligned with their corresponding first and second locking fingers.

49. The snowboard boot of claim 45, wherein the first and second opening peripheries are disposed substantially in-line with a sidewall of the snowboard boot upper.

50. The snowboard boot of claim 45, wherein a portion of the interface is disposed between the inner sole and the rubber outer sole.

51. The snowboard boot of claim 45, wherein the rubber outer sole comprises at least two physically separate and distinct outer sole portions that are not part of a unitary outer sole, the at least two outer sole portions comprising a first outer sole portion being adapted to underlie a heel area of the boot and a second outer sole portion being adapted to underlie a forefoot area of the boot.

52. The snowboard boot of claim 51, wherein the first and second outer sole portions are separated so that neither underlies a central section of the interface disposed in an instep area of the snowboard boot.

53. The snowboard boot of claim 52, wherein the rubber outer sole comprises a gap so that no portion of the rubber outer sole underlies the central section of the interface disposed in the instep area of the snowboard boot.

54. The snowboard boot of claim 45, wherein the first and second openings are disposed on opposite sides of a center of a length of the snowboard boot.

55. The snowboard boot of claim 45, wherein each of the first and second openings has a top wall, a bottom wall and a width extending between the top and bottom walls, and wherein the width of each of the first and second openings is greater than its corresponding binding engagement member to facilitate engagement between the first and second openings and their corresponding binding engagement members.

56. The snowboard boot of claim 45, wherein each of the toe-end sidewalls and the heel-end sidewalls is curved.

57. The snowboard boot of claim 49, wherein a portion of the interface is disposed between the inner sole and the rubber outer sole.

58. The snowboard boot of claim 45, wherein a forward one of the first and second openings is disposed at approximately a center of a length of the snowboard boot.

59. The snowboard boot of claim 45, wherein each of the first and second openings is constructed and arranged so that when the corresponding binding engagement members move into mating engagement with the first and second openings, any snow contained in the first and second openings is cammed out therefrom.

60. The snowboard boot of claim 57, wherein each of the toe-end sidewalls and the heel-end sidewalls is curved.

61. The snowboard boot of claim 45, wherein the alignment feature is an additional opening in the interface adapted to receive the corresponding feature in the binding.

62. The snowboard boot of claim 45, wherein the first and second openings are arranged on the interface so that when the first and second openings engage their corresponding binding engagement members, a principle load generated on the interface is a shear force.

63. The snowboard boot of claim 45, wherein the interface terminates rearwardly of a toe area of the snowboard boot so that the interface does not underlie the toe area of the snowboard boot.

64. The snowboard boot of claim 45, wherein the sole has a toe area adapted to underlie the toes of a wearer's foot, and wherein the sole is flexible in the toe area.

65. The snowboard boot of claim 45, wherein the snowboard boot comprises a metal plate disposed in an instep area of the snowboard boot.

66. The snowboard boot of claim 65, wherein the metal plate terminates rearwardly of a toe area of the snowboard boot so that the metal plate does not underlie the toe area of the snowboard boot.

67. The snowboard boot of claim 65, wherein the interface comprises the metal plate.

68. The snowboard boot of claim 65, wherein the interface is formed of a non-metallic material.

69. The snowboard boot of claim 45, wherein the interface is a single molded piece.

70. The snowboard boot of claim 45, wherein the interface further comprises at least one additional opening disposed on a side of the snowboard boot opposite the same side on which the first and second openings are disposed.

71. The snowboard boot of claim 45, wherein the side of the snowboard boot on which the first and second openings are disposed is an inside of the snowboard boot.

72. The snowboard boot of claim 45, wherein the side of the snowboard boot on which the first and second openings are disposed is an outside of the snowboard boot.

73. The snowboard boot of claim 45, wherein the first and second opening peripheries are disposed substantially in-line with a sidewall of the snowboard boot upper;

wherein a portion of the interface is disposed between the inner sole and the rubber outer sole;

wherein each of the toe-end sidewalls and the heel-end sidewalls is curved;

wherein a region of the snowboard boot wherein the interface comprises the first and second openings is stiffer than a forefoot region of the snowboard boot; and wherein the interface comprises a metal plate disposed in an instep area of the snowboard boot.

74. The snowboard boot of claim 73, in combination with the binding.

75. A snowboard boot, comprising:

a sole comprising an inner sole and a rubber outer sole, wherein the inner and outer soles are permanently attached to each other;

an interface, non-releasably attached to the sole, to interface the snowboard boot to a binding, the interface comprising first and second opening peripheries respectively defining first and second openings disposed on a same lateral side of the interface, each of the first and second openings being adapted to receive a corresponding engagement member on the binding, the first opening being disposed forward of the second opening and being disposed at an instep area of the snowboard boot; and wherein a portion of the interface is disposed between the inner sole and the rubber outer sole.

76. The snowboard boot of claim 75, wherein each one of the first and second openings having a toe-end sidewall that closes a toe-facing edge of the one of the openings and a heel-end sidewall that closes a heel-facing edge of the one of the openings.

77. The snowboard boot of claim 75, wherein the boot has a toe area adapted to underlie the toes of a wearer's foot, and wherein the boot is flexible in the toe area to facilitate walking in the boot.

78. The snowboard boot of claim 75, wherein the snowboard boot is free of any attachment feature, adapted to engage with the binding, that is disposed forward of the in-step area.

79. A snowboard boot, comprising:

a sole comprising an inner sole and a rubber outer sole, wherein the inner and outer soles are permanently attached to each other;

an interface attached to the sole, the interface comprising a first lateral sidewall and a second lateral sidewall opposite the first lateral sidewall, the interface comprising at least one opening adapted to mate with a corresponding engagement member on a binding, the at least one opening extending into the first lateral sidewall of the interface without extending through the boot to the second lateral sidewall of the interface, the at least one opening having a toe-end sidewall that closes a toe-facing edge of the at least one opening and a heel-end sidewall that closes a heel-facing edge of the at least one opening, the toe-end and heel-end sidewalls of the at least one opening being adapted to engage the corresponding engagement member; and wherein a portion of the interface is disposed between the inner sole and the rubber outer sole.

80. A snowboard boot for use with a snowboard, comprising:

a sole comprising an inner sole and an outer sole; and an interface to interface the snowboard boot to a binding, the interface being attached to the sole with at least a portion of the interface being disposed between the inner sole and the outer sole, the interface comprising at least one opening periphery defining at least one opening disposed on a lateral side of the snowboard boot, the at least one opening being adapted to receive a corresponding engagement member on the binding, the at least one opening having a toe-end sidewall that closes a toe-facing edge of the at least one opening and a heel-end sidewall that closes a heel-facing edge of the at least one opening, the snowboard boot being free of any attachment feature that is adapted to engage with the binding or snowboard and is disposed forward of the in-step area.

81. The snowboard boot of claim 80, wherein the outer sole comprises at least two physically separate and distinct outer sole portions that are not part of a unitary outer sole, the at least two outer sole portions comprising a first outer sole portion adapted to underlie a heel area of the boot and a second outer sole portion adapted to underlie a forefoot area of the boot.

82. The snowboard boot of claim 80, wherein the toe-end sidewall and the heel-end sidewall each is curved.

83. The snowboard boot of claim 80, wherein a region of the snowboard boot wherein the interface comprises the at least one opening is stiffer than a forefoot region of the snowboard boot.

84. The snowboard boot of claim 80, wherein the boot has a toe area adapted to underlie the toes of a wearer's foot, and wherein the boot is flexible in the toe area to facilitate walking in the boot.

85. The snowboard boot of claim 80, wherein the interface further comprises an alignment feature adapted to engage with a corresponding feature in the binding when the at least opening is aligned with the binding engagement member.

86. The snowboard boot of claim 85, wherein the alignment feature is an additional opening in the interface adapted to receive the corresponding feature in the binding.

87. The snowboard boot of claim 80, wherein the interface terminates rearwardly of a toe area of the snowboard boot so that the interface does not underlie the toe area of the snowboard boot.

88. The snowboard boot of claim 80, wherein the interface comprises a metal plate disposed in an instep area of the snowboard boot.

89. The snowboard boot of claim 80, wherein the at least one opening comprising an opening periphery that is disposed substantially in-line with a sidewall of the snowboard boot.

90. The snowboard boot of claim 80, wherein the outer sole is formed of rubber, and wherein a portion of the interface is disposed between the inner sole and the rubber outer sole.

91. The snowboard boot of claim 90, wherein the rubber outer sole comprises at least two physically separate and distinct outer sole portions that are not part of a unitary outer sole, the at least two outer sole portions including a first outer sole portion being adapted to underlie a heel area of the boot and a second outer sole portion being adapted to underlie a forefoot area of the boot.

92. The snowboard boot of claim 91, wherein the first and second outer sole portions are separated so that neither underlies a central section of the interface disposed in an instep area of the snowboard boot.

93. The snowboard boot of claim 92, wherein the rubber outer sole comprises a gap so that no portion of the rubber outer sole underlies the central section of the interface disposed in the instep area of the snowboard boot.

94. The snowboard boot of claim 80, wherein the at least one opening comprises first and second openings that are disposed on opposite sides of a center of a length of the snowboard boot.

95. The snowboard boot of claim 80, wherein the at least one opening has a top wall, a bottom wall and a width extending between the top and bottom walls, and wherein the width of the at least one opening is greater than its corresponding binding engagement member to facilitate engagement between the at least one opening and its corresponding binding engagement member.

96. The snowboard boot of claim 80, wherein at least one opening comprises first and second openings, and wherein a forward one of the first and second openings is disposed at approximately a center of a length of the snowboard boot.

97. The snowboard boot of claim 80, wherein the at least one opening is constructed and arranged so that when the corresponding binding engagement member moves into mating engagement with the at least one opening, any snow contained in the at least one opening is cammed out therefrom.

98. The snowboard boot of claim 97, wherein each of the toe-end sidewalls and the heel-end sidewalls is curved.

99. The snowboard boot of claim 80, wherein the at least one opening is arranged on the interface so that when the at least one opening engages its corresponding binding engagement member, a principle load generated on the interface is a shear force.

100. The snowboard boot of claim 88, wherein the metal plate terminates rearwardly of a toe area of the snowboard boot so that the metal plate does not underlie the toe area of the snowboard boot.

101. The snowboard boot of claim 100, wherein the interface comprises the metal plate.

102. The snowboard boot of claim 80, in combination with the binding.

103. The snowboard boot of claim 80, wherein the interface is formed of a non-metallic material.

104. The snowboard boot of claim 80, wherein the interface is a single molded piece.

105. The snowboard boot of claim 80, wherein the interface further comprises at least one additional opening disposed on a side of the snowboard boot opposite the side on which the at least one opening is disposed.

106. The snowboard boot of claim 80, wherein the side of the snowboard boot on which the at least one opening is disposed is an inside of the snowboard boot.

107. The snowboard boot of claim 80, wherein the side of the snowboard boot on which the at least one opening is disposed is an outside of the snowboard boot.

108. The snowboard boot of claim 89, wherein the interface further comprises an alignment feature adapted to engage with a corresponding feature in the binding when the at least one opening is aligned with its corresponding binding engagement member, and wherein the alignment feature is an additional opening in the interface adapted to receive the corresponding feature in the binding.

109. The snowboard boot of claim 108, wherein the sole has a toe area adapted to underlie the toes of a wearer's foot, and wherein the sole is flexible in the toe area.

110. The snowboard boot of claim 109, wherein the snowboard boot comprises a metal plate disposed in an instep area of the snowboard boot, and wherein the interface comprises the metal plate.

111. The snowboard boot of claim 109, wherein the outer sole is formed rubber, and wherein a portion of the interface is disposed between the inner sole and the rubber outer sole.

112. The snowboard boot of claim 84, wherein the interface further comprises an alignment feature adapted to engage with a corresponding feature in the binding when the first and second openings are aligned with their corresponding binding engagement members, and wherein the alignment feature is an additional opening in the interface adapted to receive the corresponding feature in the binding.

113. The snowboard boot of claim 84, wherein the snowboard boot comprises a metal plate disposed in an instep area of the snowboard boot, and wherein the interface comprises the metal plate.

114. The snowboard boot of claim 84, wherein the sole comprises an inner sole and a rubber outer sole, and wherein a portion of the interface is disposed between the inner sole and the rubber outer sole.

115. The snowboard boot of claim 84, wherein each of the toe-end sidewalls and the heel-end sidewalls is curved.

116. The snowboard boot of claim 83, wherein a region of the snowboard boot wherein the interface includes the first and second openings is stiffer than a forefoot region of the snowboard boot.

117. The snowboard boot of claim 116, wherein the snowboard boot comprises a metal plate disposed in an instep area of the snowboard boot, and wherein the interface includes the metal plate.

118. The snowboard boot of claim 84, wherein the first and second opening peripheries are disposed substantially in-line with a sidewall of the snowboard boot upper.

119. The snowboard boot of claim 80, wherein the first and second opening peripheries are disposed substantially in-line with a sidewall of the snowboard boot upper;

wherein the outer sole is formed of rubber and wherein a portion of the interface is disposed between the inner sole and the rubber outer sole;

wherein each of the toe-end sidewalls and the heel-end sidewalls is curved;

wherein a region of the snowboard boot wherein the interface comprises the at least one opening is stiffer than a forefoot region of the snowboard boot;

wherein the interface further comprises an alignment feature adapted to engage with a corresponding feature in the binding when the at least one opening is aligned with its corresponding binding engagement member, the alignment feature being an additional opening in the interface adapted to receive the corresponding feature in the binding; and wherein the interface comprises a metal plate disposed in an instep area of the snowboard boot.

120. The snowboard boot of claim 119 in combination with the binding.

121. A snowboard boot, comprising:

a sole comprising an inner sole and an outer sole; and an interface to interface the snowboard boot to a binding, the interface having a bottom surface, the interface being attached to the sole such that at least a portion of the of the bottom surface of the interface is disposed between the inner sole and the outer sole, the interface comprising at least one opening periphery defining at least one opening disposed on a lateral side of the interface, the at least one opening being adapted to receive an engagement member on the binding;

wherein the boot has a toe area adapted to underlie the toes of a wearer's foot, and wherein the boot is flexible in the toe area to facilitate walking in the boot.

122. The snowboard boot of claim 121, wherein the at least one opening has a toe-end sidewall that closes a toe-facing edge of the at least one opening and a heel-end sidewall that closes a heel-facing edge of the opening.

123. The snowboard boot of claim 122, wherein the toe-end sidewall and the heel-end sidewall each is curved.

124. The snowboard boot of claim 121, wherein the outer sole comprises at least two physically separate and distinct outer sole portions that are not part of a unitary outer sole, the at least two outer sole portions comprising a first outer sole portion adapted to underlie a heel area of the boot and a second outer sole portion adapted to underlie a forefoot area of the boot.

125. The snowboard boot of claim 121, wherein a region of the snowboard boot wherein the interface comprises the at least one opening is stiffer than a forefoot region of the snowboard boot.

126. The snowboard boot of claim 121, wherein the interface further comprises an alignment feature adapted to engage with a corresponding feature in the binding when the at least opening is aligned with the binding engagement member.

127. The snowboard boot of claim 126, wherein the alignment feature is an additional opening in the interface adapted to receive the corresponding feature in the binding.

128. The snowboard boot of claim 121, wherein the interface terminates rearwardly of a toe area of the snowboard boot so that the interface does not underlie the toe area of the snowboard boot.

129. The snowboard boot of claim 121, wherein the interface comprises a metal plate disposed in an instep area of the snowboard boot.

* * * * *